US006035887A

United States Patent [19]

Cato

[11] Patent Number: 6,035,887

[45] Date of Patent: Mar. 14, 2000

[54] VALVE ASSEMBLY

[76] Inventor: Steven H. Cato, 202 Cedar Dale Dr., Central, S.C. 29630

[21] Appl. No.: 09/112,947

[22] Filed: Jul. 9, 1997

[51] Int. Cl.[7] ..... F16L 55/18

[52] U.S. Cl. ..... 137/364; 137/343; 137/372; 251/143; 239/201

[58] Field of Search ..... 137/315, 363, 137/364, 236.1, 343, 372; 251/143; 239/201, 200

[56] References Cited

U.S. PATENT DOCUMENTS

| | | | |
|---|---|---|---|
| 983,311 | 2/1911 | McCreedy et al. . | |
| 997,434 | 7/1911 | Barnes | 137/372 |
| 2,805,099 | 9/1957 | Bailey | 299/60 |
| 3,525,353 | 8/1970 | Parks | 137/363 |
| 3,730,213 | 5/1973 | Bates | 137/364 |
| 3,759,445 | 9/1973 | King | 239/201 |
| 3,792,711 | 2/1974 | Bedard | 137/217 |
| 3,929,288 | 12/1975 | Brusadin et al. | 239/201 |
| 3,961,528 | 6/1976 | Ford | 73/201 |
| 4,243,068 | 1/1981 | Sugda et al. | 137/363 |
| 4,310,015 | 1/1982 | Stewart et al. | 137/364 |
| 4,314,717 | 2/1982 | Bjurman | 285/5 |
| 4,317,471 | 3/1982 | King, Sr. | 137/798 |
| 4,355,197 | 10/1982 | Jonsson | 174/37 |
| 4,492,249 | 1/1985 | Arino et al. | 137/515 |
| 4,562,962 | 1/1986 | Hartman | 239/200 |
| 4,691,727 | 9/1987 | Zorb et al. | 137/15 |
| 4,691,733 | 9/1987 | Zinn | 137/364 |
| 4,926,899 | 5/1990 | Argandona | 137/364 |
| 5,394,898 | 3/1995 | Turner | 137/371 |
| 5,511,574 | 4/1996 | Macke | 137/15 |

*Primary Examiner*—A. Michael Chambers
*Assistant Examiner*—Paul Coryea
*Attorney, Agent, or Firm*—Henry S. Jaudon; Cort Flint

[57] ABSTRACT

A valve housing assembly for use with permanent watering systems for yards, gardens, etc. The watering system includes underground substantially rigid conduits for supplying water to the system and delivering water to the delivery units. The valve assembly interconnects the supply and delivery conduits. The valve assembly includes a housing supporting a control valve and having outlet and inlet pipes which interconnect with the valve and the inlet and outlet conduits. The inlet and outlet pipes are flexible which allows connection with conduits which are slightly misaligned. The pipes also have quick release connectors which provides quick connect and disconnect with the valve and inlet and outlet conduits. The valve mount is interchangeable between other valve mounts to accommodate a plurality of value case structures.

18 Claims, 3 Drawing Sheets

VALVE ASSEMBLY

BACKGROUND OF THE INVENTION

The instant invention is directed to an improved valve assembly for use with watering systems for yards, gardens, etc.

Valve assemblies, and meter assemblies are well known. Particularly, in the known valve assemblies, there is a lack of flexibility during installation as the conduits which connect with the valve units are not flexible. Also, these assemblies do not provide structure which provides for easy replacement of the valve unit. Valve assemblies with these features are described are disclosed in U.S. Pat. Nos. 2,805,099 and 5,511,574 to Bailey and Macke.

Known valve assemblies require that the incoming and outgoing conduits be aligned both horizontally and vertically during installation thereof. This is because neither the valve assembly or the inlet or outlet conduits forming the watering system are flexible. This is a very time consuming and tedious operation. Also, when the valve malfunctions, the entire area around the valve box housing must be dug up so that a new housing assembly can be connected with the rigid inlet and outlet conduits.

It is a primary object of the instant invention to provide a valve assembly with a quick connect system which allows easy replacement of the valve unit.

Another object of the invention is a valve assembly with interchangeable valve mounts.

Another object of the invention is a valve assembly which includes inlet and outlet pipes having quick connect assemblies at each end.

Another object of the invention is a valve assembly which includes flexible inlet and outlet pipes.

Another object of the invention is a valve assembly having a plurality of valves.

SUMMARY OF THE INVENTION

The invention is directed to a novel valve housing assembly for use with watering systems for yards, gardens, etc. The valve assembly includes a unitary housing, preferably formed of plastic, comprising a floor, four sides, and a top.

The floor is formed with a seat for seating a valve mount. The valve mount includes valve seating fingers which are adapted to engage or cradle a valve in a fixed position within the valve housing.

The valve housing assembly includes a plurality of interchangeable valve mounts which are each constructed to support a different make valve or valves having various case configurations.

A pair of holes are provided in selected opposed walls. An inlet pipe is carried in a first hole and connects with an inlet side of the valve. An outlet pipe is carried in the second hole and connects with the outlet of the valve. O-ring seals secure the pipes in the holes.

The opposite ends of the pipes are connected with the inlet and outlet conduits respectively of the watering system. The pipes are flexible and the connections are made with quick release connectors.

Because of the quick release connectors and the flexible pipes, the housing assembly is easily joined into the watering system as the rigid inlet and outlet conduits of the watering system do not have to be precisely aligned. Also, the quick release connectors and the valve mount allow easy access to the valve unit, allowing valve replacement without disturbing the connections with the valve housing assembly.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
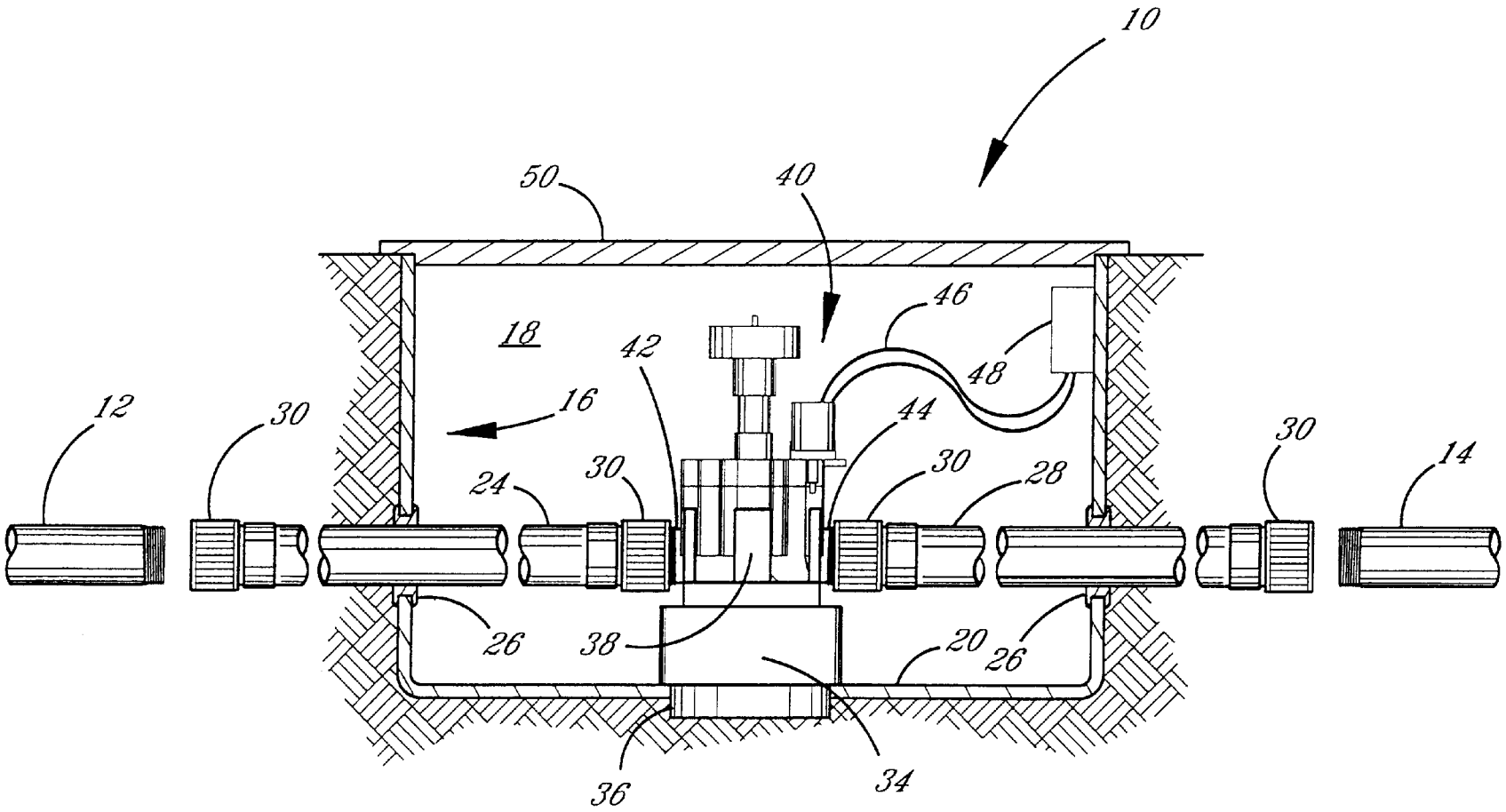
FIG. 1 is a side sectional view of a first species of the valve assembly of the invention.

Turning now to FIG. 1, a primary construction of valve assembly 10 according to the invention is shown. The valve assembly is designed for use with underground watering systems for yards, gardens, etc. and is intended to interconnect inlet conduits, such as shown at 12, with outlet conduits, such as shown at 14. Normally, conduits 12 and 14 are formed of PVC which is a substantially rigid synthetic material. The conduits are buried a desired depth with inlet conduit 12 being connected to a water supply and outlet conduit 14 being connected with a series of pop-up sprinklers arranged over the watering area.

Valve assembly 10 (FIGS. 1 and 3) includes housing or box 16 having vertical sides 18 and floor or bottom 20 formed as an integral unit. Preferably housing 16 is a molded plastic unit.

Housing 16 is formed with a pair of opening 22 formed in opposed sides at about their mid-point. Inlet pipe 24 is mounted in a first opening 22 and secured with an O-ring seal 26. Outlet pipe 28 is mounted in the other opening 22 and is secured by another O-ring seal 26. Each end of pipes 24 and 28 carries a quick connect unit 30. Pipes 24 and 28 are preferably made of cross-linked polyethylene which allows them to be flexible. Other synthetic material having appropriate strength and flexibility may be used. Also quick connect 30 may be of any known structure.

Figure 3:
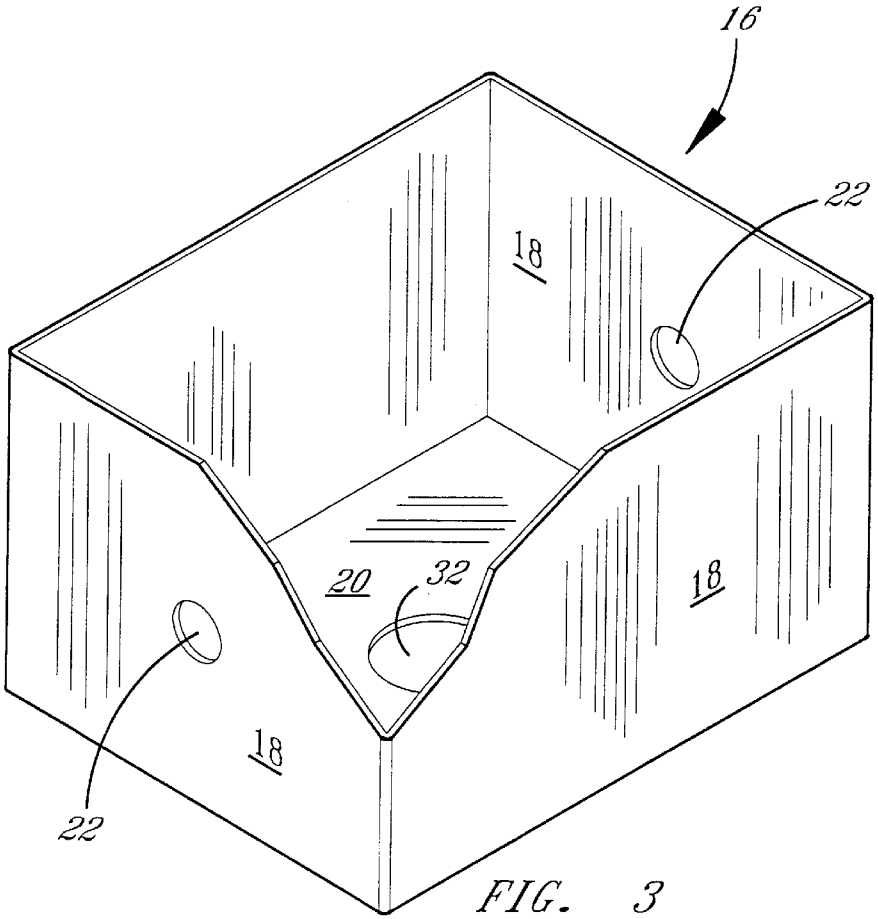
FIG. 3 is a cutaway perspective view of the housing of the novel valve assembly.

A third opening 32 is formed substantially centrally of floor 20. Opening 32 is preferably a circular opening, as shown in FIG. 3, which passes completely through floor 20. Obviously, opening 32 could be formed to any desired shape, the only requirement being that it mates with the shape of foot 36. Valve mount 33, which includes foot 36 and mounting fingers 38, mounts in opening 32. A slight depression may be formed in the earth below opening 32 to accommodate foot 36 as the valve mount is firmly seated on floor 20 as shown in FIG. 1.

Valve 40 is held in fixed position by fingers 38 of valve or control valve mount 34 with its inlet extension 42 directed toward inlet pipe 24 and outlet extension 44 directed toward outlet pipe 28. Quick release connectors 30 connect the pipes with valve 40.

At the present time there are only two major valve brands, TORRO and Rain Bird, on the market. These valves operate in similar manner, but their case structures vary slightly. Valve assembly 10 is provided with a pair of valve mounts 34, 34', each designed with teeth or fingers 38, 38' which are positioned to engage with the valve case to stationarily mount the valve within housing 16. Teeth 38 may be altered or rearranged to fit with any case structure to securely seat or mount the valve. Each valve mount 34, 34' includes a foot 36 which seats in opening 32.

An electrical connection box 48 is mounted with a side 18 and connects valve 40 with an electrical supply through leads 46.

In practice, conduits 12 and 14 are positioned underground and directed to their appropriate destinations. Housing assembly 10 is positioned in the excavated area between opposing ends of the two conduits. Inlet conduit 36 is connected with inlet pipe 24 by connector 30 and outlet conduit 14 is connected to outlet pipe 28 by quick release 30. Because pipes 24, 28 are flexible conduits 12 and 14 do not have to be precisely aligned vertically or horizontally for the connections to be easily and quickly made. The earth is now filled in around housing assembly 10 and top or lid 50 is positioned on upper ends of sides 18 to close the unit.

When valve 40 malfunctions, it is replaced by simply removing top 50, disconnecting pipes 24 and 28 from extensions 42, 44 and leads 46 from connector 48 and lifting the valve from housing 16. A replacement valve 40 is seated on valve mount 34 and connected with members 24, 28, and 48. Should a different brand valve be the replacement valve, valve mount 38' is substituted for valve mount 34 prior to installation.

Figure 2:
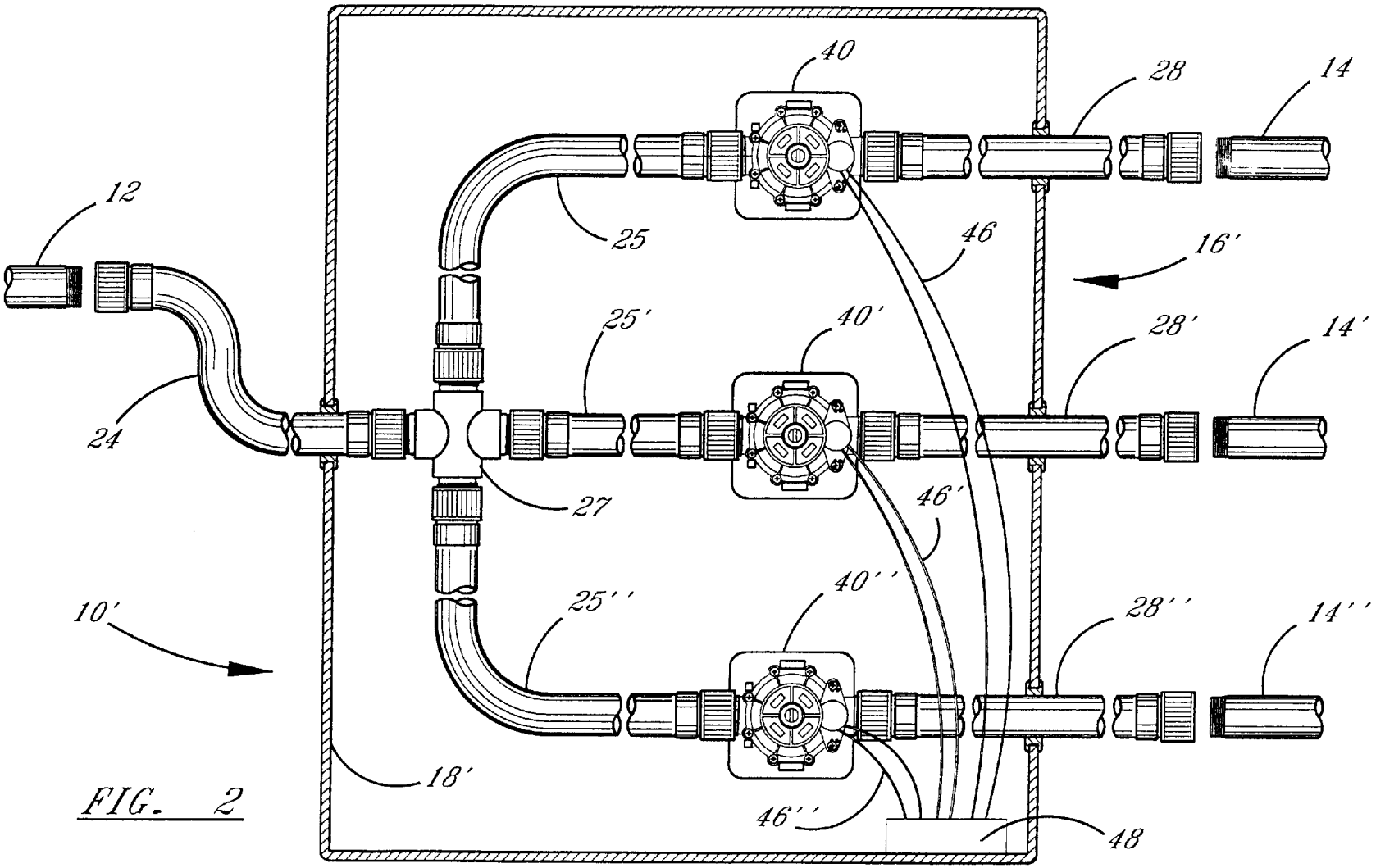
FIG. 2 is a top sectional view of a second species of the valve assembly of FIG. 1.
Figure 4:
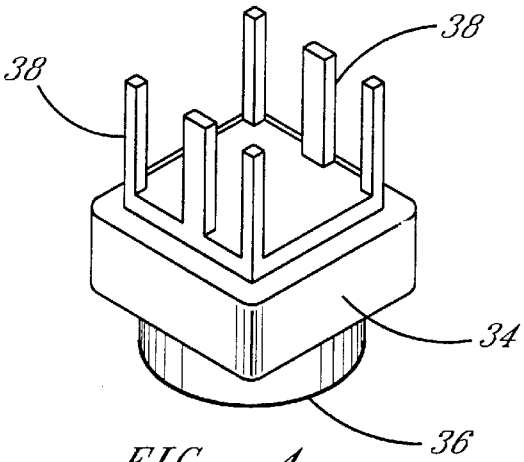
FIG. 4 is a perspective view of a first valve mount.
Figure 5:
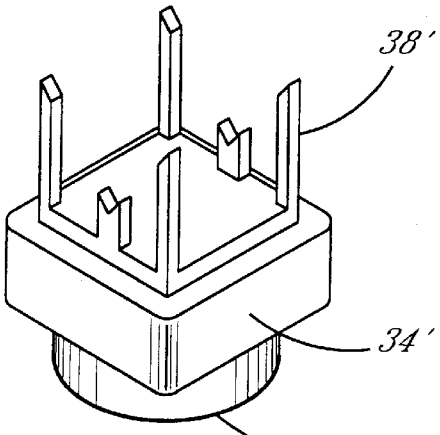
FIG. 5 is a perspective view of a second valve mount.

The valve housing assembly of the invention may include a plurality of valves and outlet pipes as shown in FIG. 2 at 10'. Here the valve assembly has a single inlet pipe 24 mounted in a first side 18' of housing 16' and three outlet pipes 28, 28', and 28" mounted in the opposed side. There are three valves 40, 40', 40" each seated in a respective valve mount and connected with inlet pipe 24 through junction member 27 and second inlet pipes 25, 25', 25". Each outlet pipe 28, 28', 28" is connected with an outlet conduit 14, 14', 14" which supply separate watering fields. Electrical connector 48 may be programmed to actuate the valves sequentially, together, or in a patterned sequence. Alternatively, second inlet pipes 25, 25', and 25" could be non-flexible in this arrangement with only inlet pipe 24 being flexible on the inlet side.

In the arrangement of FIG. 2, valves 40, 40', 40" may be replaced all at once or one at a time as needed. In valve housing assembly 10', the system may continue to operate through two valves while the third is being replaced.

While a preferred embodiment of the invention has been described using specific terms, such description is for illustrative purposes only, and it is to be understood that changes and variations may be made without departing from the spirit or scope of the following claims.

What is claimed is:

1. A valve housing assembly for connecting with buried and substantially rigid pipes of underground watering systems said pipes forming supply and feed conduits comprising:

a plastic housing having a floor, sides and a top, said floor including a valve mount seat, an inlet pipe, and an outlet pipe, said inlet and outlet pipes each having quick release connectors on each end thereof;

a valve mount removably seated on said floor in said valve mount seat;

a valve removably seated in said valve mount, said valve connecting with said quick release connectors of said inlet and outlet pipes; whereby, said valve of said valve housing assembly may be exchanged without disturbing said housing.

2. The assembly of claim 1 including a plurality of said valve mounts which are selectively interchangeable dependent upon the case structure of said valve.

3. The assembly of claim 1 wherein said valve mount includes a plurality of vertical support fingers which retain said valve in a vertical position.

4. The assembly of claim 1 wherein said valve mount seat comprises a shaped opening in said floor.

5. The assembly of claim 4 wherein said valve mount includes a base shaped to conform with said shaped opening, said base being adapted to be removably seated within said opening.

6. The assembly of claim 1 wherein said inlet and outlet pipes are formed of flexible material.

7. The assembly of claim 6 wherein said inlet and outlet pipes pass through opening in opposing of said sides of said housing.

8. The assembly of claim 7 wherein said openings are provided with ring seals.

9. The assembly of claim 1 including an electrical connector secured with a selected of said sides and electrical leads interconnecting said valve with said electrical connector.

10. The assembly of claim 1 including a plurality of said outlet pipes connecting through a plurality of valves with said inlet pipe.

11. A valve housing assembly for use with an underground watering system, said assembly interconnecting a substantially rigid inlet conduit with a substantially rigid outlet conduit feeding a sprinkler system, said assembly comprising:

a valve housing having a floor, a plurality of sides and a removable top, said floor and sides being adapted to be positioned underground between said inlet conduit and said outlet conduit;

a valve mount carried by said floor;

a valve removably seated in a fixed position within said housing by said valve mount;

a flexible inlet pipe passing through a first of said sides, said inlet pipe having a quick release connector at at least one end;

a flexible outlet pipe passing through a second of side sides, said outlet pipe having a quick release connector at each end;

said inlet and outlet pipes connecting with said inlet and outlet conduits and with inlet and outlet sides of said valve seated in valve mount; wherein, said assembly allows connection with said rigid inlet and outlet conduits when slightly misaligned and replacement of said valve without unearthing said valve housing.

12. The valve assembly of claim 11 wherein said floor includes valve mount seat in which said valve mount is removably seated.

13. The valve assembly of claim 11 wherein said valve mount comprises a body portion having a plurality of mounting fingers extending from one side thereof, said fingers being adapted to securely seat a valve of selected configuration.

14. The valve assembly of claim 13 wherein said valve mount is interchangeable with other valve mounts having fingers adapted to securely seat valves with other case configuration.

15. The valve assembly of claim 11 including a plurality of said outlet pipes each connected with one of a plurality of said valves and a single said inlet pipe connected with each said valve of said plurality of said valves.

16. A valve housing assembly for receiving and connecting with a selected of a plurality of control valves and for connecting with substantially rigid underground pipes of underground watering systems, said housing assembly comprising:

a shaped valve box having four sides, a bottom, and an open top;

a lid adapted to fit with said sides to close said open top;

an electrical connection box, including electrical leads for connecting with said selected of said valves, secured with one of said sides in the vicinity of said top;

a valve mount seat formed in said floor;

a plurality of variable sized valve mounts, each adapted to seat with said valve mount seat and each adapted to seat one of said plurality of control valves; wherein, a selected of said control valves may be seated in a selected of said valve mounts and said selected valve mount may be seated in said valve mount seat within said housing for connection with said electrical connection box and said underground watering system.

17. The system of claim 16 including inlet and outlet piping connected with opposed sides of said valve box, said inlet piping being adapted to connect with a water supply pipe of said pipes of said watering systems and said selected control valve and said outlet piping being adapted to connect with feed line pipes of said pipes of said watering systems and said control valve.

18. The system of claim 17 wherein at least one of said inlet and outlet piping comprises flexible piping having a quick release connector at least one end thereof.

* * * * *